US009289087B2

(12) United States Patent
Richards et al.

(10) Patent No.: US 9,289,087 B2
(45) **Date of Patent: *Mar. 22, 2016**

(54) MOTORIZED DRAPERY ROD ASSEMBLY

(71) Applicants: Clinton Henry Richards, Las Vegas, NV (US); Jeniece Mayhugh Richards, Las Vegas, NV (US)

(72) Inventors: Clinton Henry Richards, Las Vegas, NV (US); Jeniece Mayhugh Richards, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/688,473

(22) Filed: Apr. 16, 2015

(65) Prior Publication Data

US 2015/0230648 A1 Aug. 20, 2015

Related U.S. Application Data

(62) Division of application No. 13/892,002, filed on May 10, 2013, now Pat. No. 9,033,296, which is a division of application No. 13/385,041, filed on Jan. 30, 2012, now Pat. No. 8,479,931.

(51) Int. Cl.

| | |
|---|---|
| ***A47H 1/00*** | (2006.01) |
| ***A47H 1/142*** | (2006.01) |
| ***A47H 1/022*** | (2006.01) |
| ***A47H 5/032*** | (2006.01) |

(52) U.S. Cl.

CPC ..... *A47H 1/142* (2013.01); *A47H 1/022* (2013.01); *A47H 5/0325* (2013.01)

(58) Field of Classification Search

CPC ..... A47H 1/02; A47H 1/00; A47H 1/022; A47H 1/03; A47H 1/13; A47H 1/14; A47H 1/142; A47H 5/0325; A47G 25/06; A47G 29/10

USPC ..... 248/251, 261, 263–269, 271–272; 211/105.1, 105.2, 105.3; 160/331

See application file for complete search history.

(56) References Cited

U.S. PATENT DOCUMENTS

| | | | |
|---|---|---|---|
| 3,766,597 | A | 10/1973 | Ford |
| 3,946,978 | A | 3/1976 | Evans |
| 4,120,474 | A | 10/1978 | Hurley |
| 4,140,294 | A | 2/1979 | Zwarts |
| 4,179,091 | A | 12/1979 | Bidney |
| 4,465,198 | A | 8/1984 | Martin |
| 4,978,094 | A | 12/1990 | Ford |
| 5,529,273 | A | 6/1996 | Benthin |
| 6,367,755 | B1 | 4/2002 | Arenas |
| 6,382,295 | B1 | 5/2002 | Nicholson |
| 6,499,708 | B1 | 12/2002 | Cowen |
| 7,322,552 | B1 | 1/2008 | Lin |
| 7,360,576 | B2 | 4/2008 | Lin |
| 7,648,111 | B2 | 1/2010 | Goldstein |
| 7,861,989 | B2 | 1/2011 | Cross |

*Primary Examiner* — Gwendolyn W Baxter

(57) ABSTRACT

Multi-purpose drapery rod assembly uses unique rod and bracket construction to provide a superior drapery rod platform that can attach a non-motorized single drapery rod to surfaces at nearly any angle, or can motorize a traverse rod.

10 Claims, 13 Drawing Sheets

MOTORIZED DRAPERY ROD ASSEMBLY

CROSS-REFERENCE TO RELATED APPLICATIONS

This is a divisional application filed after pending divisional application Ser. No. 13/892,002 and claiming the filing date of parent application Ser. No. 13/385,041 filed Jan. 30, 2012. This divisional application contains only subject matter disclosed in the parent application, which is hereby incorporated by reference.

BACKGROUND OF THE INVENTION

1. Field of the Invention

The present invention generally relates to window drapery hardware, and more specifically to drapery rods and their mounting brackets.

2. Prior Art

Drapery is used as a window enhancement for decorative purposes as well as for insulation, to provide privacy, and to control natural light. Drapery rods of a variety of shapes and sizes have been designed to support drapery or the structures to which the drapery is attached. Drapery rods are most often mounted to a substantially parallel vertical support surface such as a wall. A first member base plate typically engages the wall while a second member establishes the distance between the wall and the rod. The needs for easy horizontal adjustment of the second member and vertical adjustment of the base plate have long been addressed by inventors in the industry (e.g., U.S. Pat. No. 4,140,294 and U.S. Pat. No. 4,179,091). More recently, inventors have turned their attention to making drapery rod assemblies and brackets more adaptable to non-traditional surfaces, or to multiple surfaces or window coverings. U.S. Pat. No. 6,736,775 offers a single-drapery rod assembly adapted to be mounted across a doorway, U.S. Pat. No. 6,382,295 offers a bracket adaptable to either mini-blinds or curtain rods, and U.S. Pat. No. 7,322,552 offers one adaptable to both the roman shade and the crisscross curtain singularly and in combination. U.S. Pat. No. 7,861,989 offers a bracket which can mount to a wall, ceiling, or opposing surfaces by adding or removing some parts of the bracket. This is significant since the mounting of a rod to opposing surfaces previously required a bracket like U.S. Pat. No. 3,946,978 quite different from those used for ceiling or wall mounting. However, a multi-purpose bracket that does not require parts to be changed out for different surfaces would be preferred to U.S. Pat. No. 7,861,989.

An assembly is needed that can easily mount a single-drapery rod to a ceiling or to a parallel or opposing vertical support surface using an inconspicuous bracket requiring little or no modification to adapt to differently-angled support surfaces.

Another need relates to the motorization of drapery rods. Electric remote controlled mechanisms for operating traverse rods have appeared on the market in increasing numbers of late, but the functionally effective ones are expensive and difficult to install. The small light-weight motors deemed necessary are themselves very expensive, and few can be attached to an existing rod. Operational inefficiency has also been a problem. US 2006/0162877 A1 and U.S. Pat. No. 7,360,576 B2 can be attached to existing traverse rods, and the latter does improve the functioning of the drive pulley with a more complex double wheel system. But the performance of both inventions, like that of previous art, is still hindered by redirections of the traverse rod's transmission cord. The cord is redirected from a horizontal direction to a vertical one before engaging the drive pulley system, then redirected back from vertical to horizontal before returning to the traverse rod. Structural complexity and cost are increased as well as wear and tear and slippage of the transmission cord. Operational efficiency and effectiveness continue to decrease over time as the cord becomes smoother. A motorized assembly is needed which is structurally simpler, does not require the redirection of transmission cords done in prior art, is easy to install with traditional traverse rods, and can support and utilize a relatively inexpensive motor effectively and aesthetically.

The present invention offers a multi-purpose drapery rod assembly which provides a superior drapery platform through unique rod and cooperating bracket construction. The drapery rod assembly has a flexible bracketing system which can attach the non-motorized single drapery rod to not only substantially parallel support surfaces such as walls, but also to ceilings and to opposing support surfaces such as those found with recessed windows. The ends of the rod can also be attached at different heights on opposed or parallel vertical support surfaces, making it adaptable to non-rectangular windows, recessed or not.

The present invention also provides an assembly which motorizes a traverse rod. The easy to install assembly is structurally simple, does not require redirection of transmission cords, and can aesthetically and more effectively utilize a bigger and heavier but less expensive motor than available alternatives.

3. Objects and Advantages

The multi-purpose drapery rod assembly offers:

1) a non-motorized single-drapery rod with unique cooperating mounting brackets that can be inconspicuously affixed to surfaces lying at nearly any angle to the rod;
2) and a drapery rod assembly which motorizes a traverse rod.

SUMMARY

The multi-purpose drapery rod assembly provides an improved motorized and non-motorized assembly. The flexible bracketing system can attach the non-motorized single-drapery rod to substantially parallel support surfaces such as walls, to ceilings, or to opposing support surfaces such as those found with recessed windows. The ends of this rod can also be attached at different heights on opposed or parallel vertical support surfaces, making the rod adaptable to non-rectangular windows whether or not they are recessed. The multi-purpose drapery rod assembly can also motorize a traverse rod.

DRAWINGS

Together with the detailed description, the accompanying drawings serve to explain and illustrate the principles and implementations of the multi-purpose drapery rod assembly and make its nature, objects, and advantages more apparent to those skilled in the art. The drawings, although not drawn to scale, illustrate multiple embodiments of the drapery rod assembly, both motorized and non-motorized.

FIG. 1B is a perspective view from above of the preferred adjustable wall mounting bracket.

Figure 10:
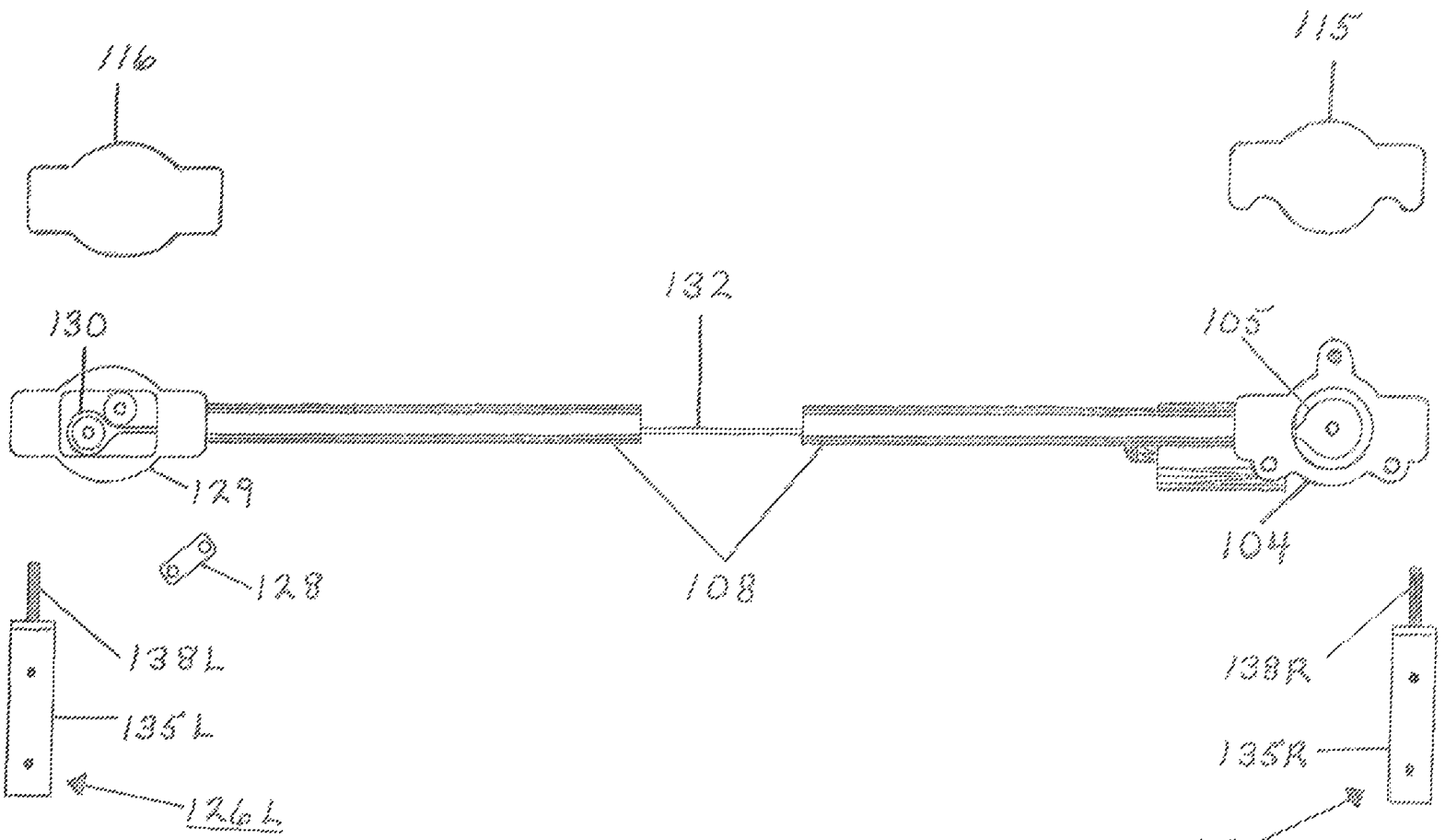

FIG. 10 provides a front view of take-up and drive pulley housings with key components and a traverse rod between them.

Figure 11:
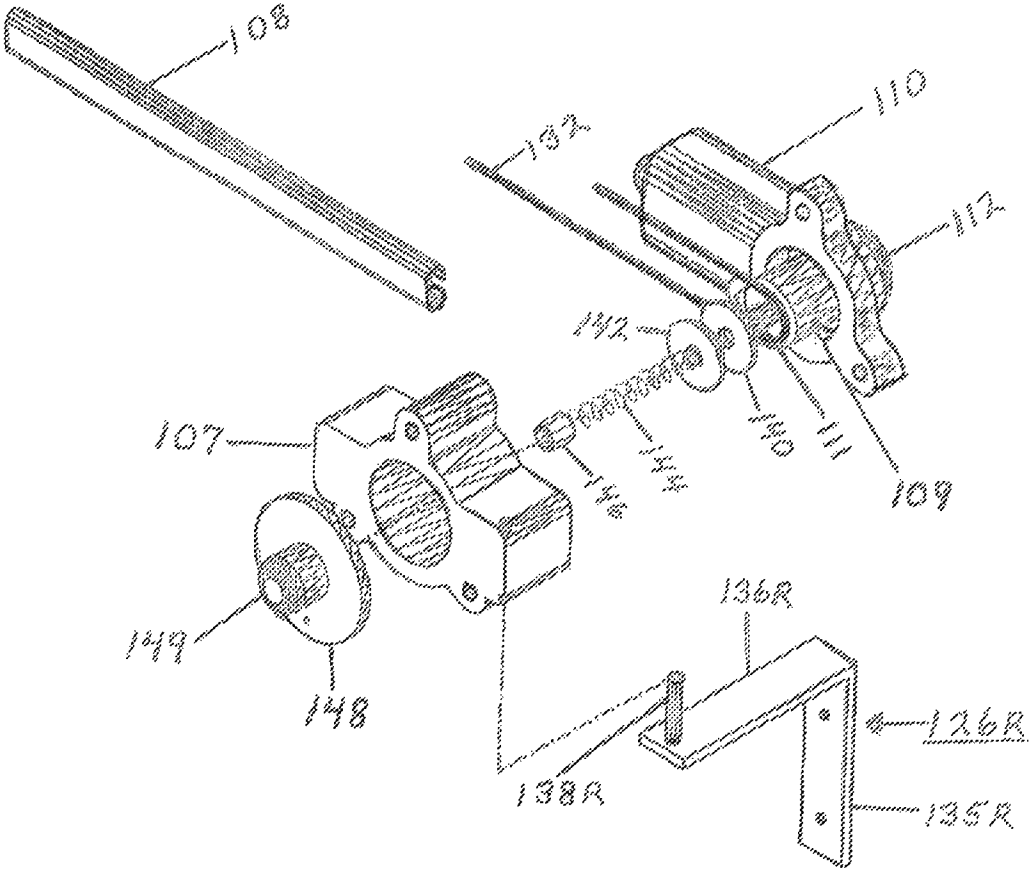

FIG. 11 is a perspective front view of a second embodiment of the drive pulley apparatus along with other key components of the assembly and a partial view of a cooperating traverse rod.

DETAILED DESCRIPTION OF INVENTION

Those of ordinary skill in the art will realize that the following detailed description of the present invention is illustrative only and not intended to be in any way limiting. Other embodiments not shown here will readily suggest themselves to such skilled persons having the benefit of this disclosure. Reference will now be made to implementations of the present invention as illustrated in the embodiments shown in the accompanying drawings. In the interest of brevity and clarity, the drawings focus on the non-routine features of the invention and therefore do not show many routine features well known to those skilled in the art. Not shown or detailed, for example, are any number of means well known in the industry for securing mounting brackets to support surfaces, providing center support for rods, finishing the edges of telescopically inter-engaged rods, and using structural ribs, ridges, and the like to increase the strength of components.

Figure 1A:
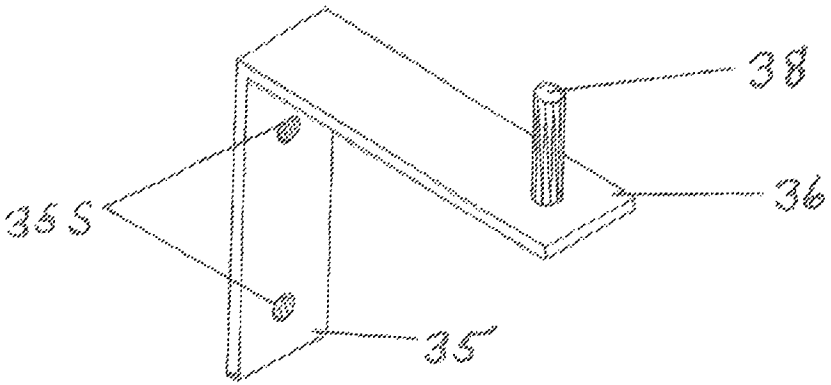
FIG. 1A is a perspective view from above of the preferred non-adjustable wall mounting bracket of the multi-purpose drapery rod assembly.
Figure 1A:
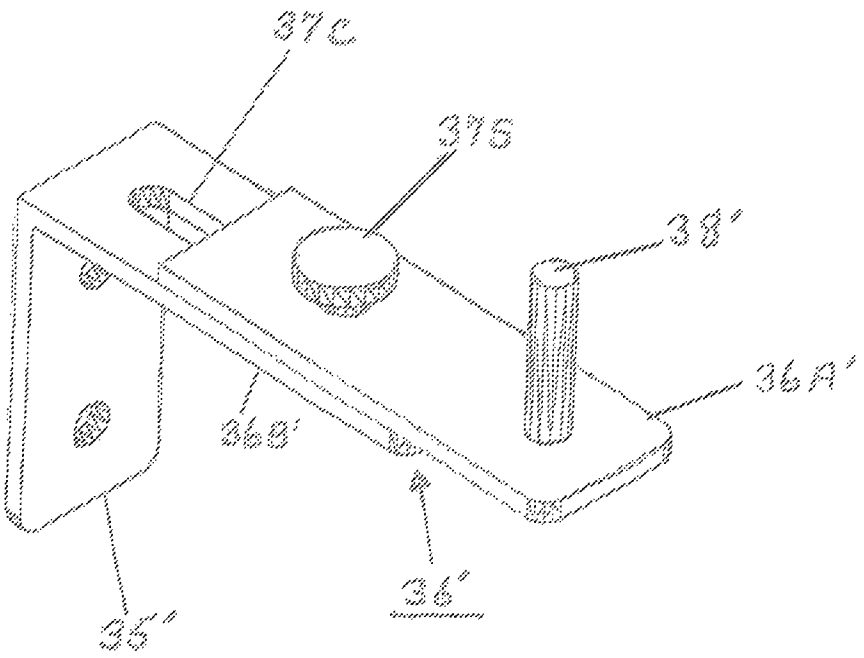

The non-adjustable and adjustable versions of the preferred wall mounting bracket are detailed in FIGS. 1A and 1B.

FIG. 1A is a perspective view from above of the preferred non-adjustable wall mounting bracket. The wall mounting bracket includes a first member comprised of a base plate 35 with a vertically elongated body, a second member 36 with a horizontally elongated body extending substantially perpendicularly from 35, and a third member 38 with a vertically elongated cylindrical body extending upwardly and substantially perpendicularly from 36. Members 35 and 36 can be formed from a single elongated plate made of metal or a similarly strong material that is bent approximately 90 degrees, or two such plates can be attached by welding, brazing, or fusing them together. Third member 38 cannot be simply an angled extension of the second member since the two are shaped very differently. It is attached to 36 by some method such as welding, brazing, or fusion.

Base plate 35 has screw holes 35S penetrating it, and a surface adapted to engage and attach to a vertical support structure using screws, wall anchors, or other similar attachment means (not shown) while second member 36 engages the bottom surface of the drapery rod. Third member 38 is sized and shaped to fit into circular apertures penetrating the rod's top and bottom surfaces at an angle substantially perpendicular to the plane of the intermediate sections of the rod, engaging the surrounding surfaces of the apertures. An advantage to using cylindrical third members is that their surrounding surfaces can be strengthened by the insertion of easily manufactured tubular reinforcements (not shown) into the apertures of what are frequently hollow telescoping rods. The fact that cylindrical third members can rotate within the apertures also has distinct advantages when used with the non-motorized single-drapery rods, those advantages to be identified when describing FIGS. 2-5.

FIG. 1B is a perspective view from above of the preferred adjustable wall mounting bracket. The base plate and third member are as described with the non-adjustable bracket. The adjustable second member 36' is similar to horizontally adjusting members shown for some time in prior art (e.g., U.S. Pat. No. 4,120,474). It is comprised of lower member 36B' and sliding upper member 36A'. Longitudinally extending channel or slot 37C in 36B' cooperates with an adjustment screw (not shown) operated with an attached head 37S to adjust 36' for desired clearance from the support surface without the need for tools. 37S is turned to loosen the screw and allow 36A' to be extended or refracted along 37C, with the range of motion being determined by the length of 37C. 37S is turned to tighten the screw at the appropriate point for desired clearance from the support structure.

The preferred wall mounting brackets of FIGS. 1A and 1B can also be adapted to adjust vertically by using vertically elongated channels or slots rather than screw holes on the base plate. Although useful, they are well known in prior art and therefore not shown. The focus in these drawings is on the non-routine features of the multi-purpose drapery rod assembly. However, it should be recognized that the addition of such a vertical adjustment mechanism is within the scope of the present invention.

The preferred wall mounting brackets of FIGS. 1A and 1B can be used to mount a drapery rod to a wall or ceiling, but the cooperating apertures in the latter case would have to penetrate through the rod horizontally rather than perpendicularly since third member 38 would extend horizontally in a ceiling mount. A collar or pin at the end of 38 would be advisable in that case to keep the rod from slipping off of 38. Alternatively, the bracket could be modified to create a ceiling mount with a third member extending downward rather than horizontally from the second member. This would require the use of a collar or pin at the end of 38 to secure the rod, but would then not require a change in the disposition of the cooperating apertures on the dual-drapery rod.

FIGS. 2-5 show non-motorized single-drapery rods mounted with the preferred non-adjustable mounting bracket of FIG. 1A onto opposing vertical support surfaces like that found surrounding recessed windows. Since the cylindrical shape of the third member allows it to rotate 360 degrees within the perpendicularly disposed receiving aperture, the base plate of the bracket can actually be attached to vertical support surfaces lying at nearly any angle from the single-drapery rod as long as the third member is further from the base plate than from the end of the rod at that angle. The brackets shown in FIGS. 1A and 1B could also be used to attach the single-drapery rods to the ceiling with the simple addition of a collar at the end of the bracket's third member.

Figure 2:
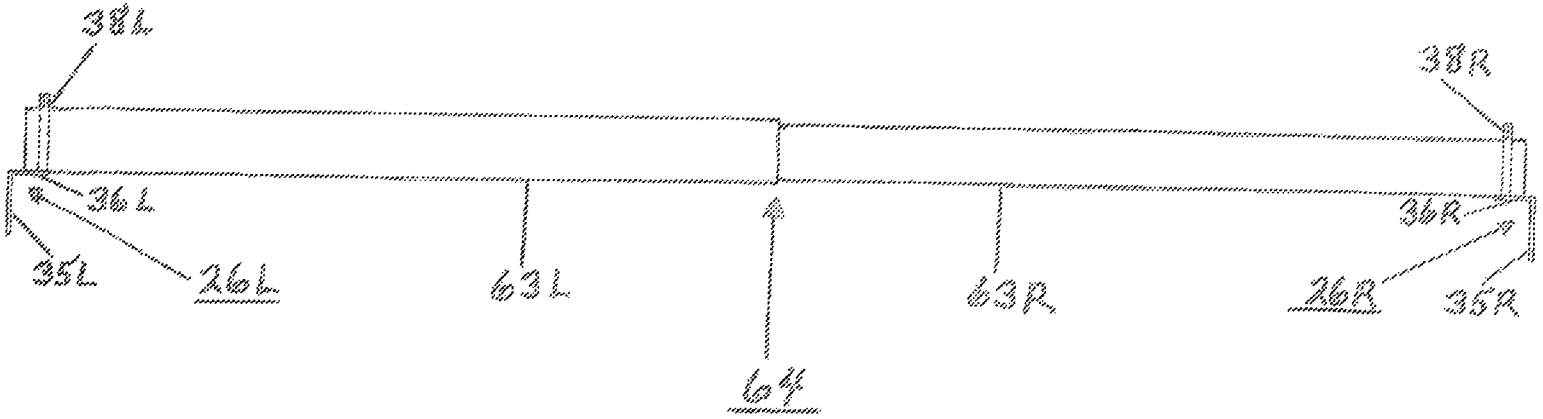
FIG. 2 is a side view of the preferred embodiment of the non-motorized single-drapery rod mounted on opposing vertical support surfaces.

FIG. 2 is a side view of the preferred embodiment mounted on opposing vertical support surfaces. Single-drapery rod 64 is comprised of telescopically inter-engaging left and right rods 63L and 63R. Apertures penetrate the rod's top and bottom surfaces in a substantially perpendicular direction at points substantially adjacent to the left end of 63L and right end of 63R. Third members 38L and 38R of mounting brackets 26L and 26R fit through the apertures and engage the surfaces surrounding the apertures while second members 36L and 36R engage the bottom surfaces of 63L and 63R and 35L and 35R engage the opposing support surfaces.

Figure 3:
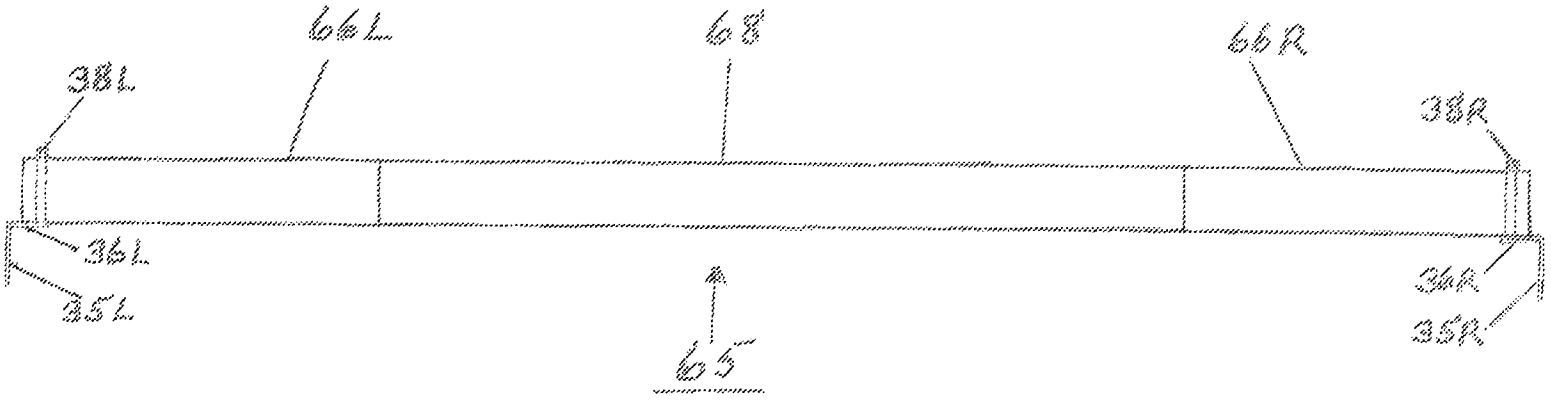
FIG. 3 is a side view of a second embodiment of that rod mounted on opposing vertical support surfaces.

FIG. 3 is a side view of a second embodiment. It has more component rods than the first, but is less reliant on center support brackets and the strength of each of the component rods to prevent the rod from sagging under the weight of a wide expanse of drapery. In this embodiment, single-drapery rod 65 is comprised of center rod 68 telescopically interengaged between left and right rods 66L and 66R. Third members 38L and 38R engage the surfaces surrounding the apertures penetrating rods 66L and 66R as in FIG. 2 while second members 36L and 36R engage the bottom surfaces of 66L and 66R and base plates 35L and 35R engage the opposing support surfaces.

Figure 4:
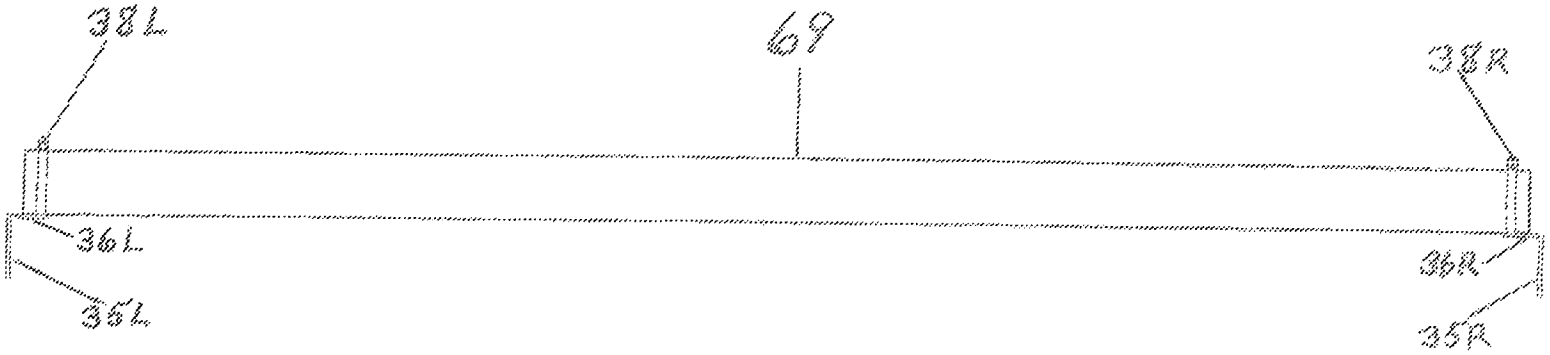
FIG. 4 is a side view of a non-motorized single-drapery rod comprised of a single rod rather than a plurality of telescoping rods mounted on opposing vertical support surfaces.

FIG. 4 is a side view of an embodiment comprised of a single rod 69 rather than a plurality of telescoping rods. Members 35, 36, and 38L and 38R operate as in FIGS. 2-3.

Figure 5:
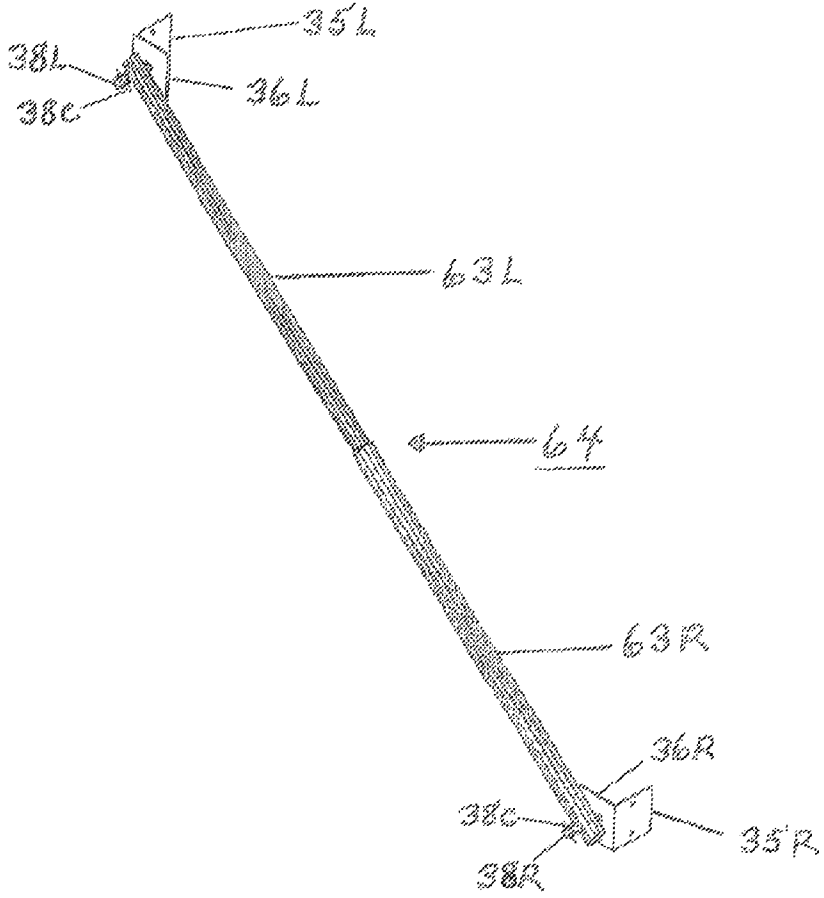
FIG. 5 is a perspective view from above and to the right of the preferred embodiment of FIG. 2 mounted to opposing surfaces at a substantially non-perpendicular angle.

FIG. 5 is perspective view from above and to the right of the preferred embodiment of the non-motorized single-drapery rod. As in FIGS. 2-4, base plates 35L and 35R are shown as if mounted on a perpendicularly disposed support surface (not shown) like that found surrounding recessed windows. However, 35L and 35R have been mounted at substantially different heights on the opposing support surfaces. This is possible if second members 36L and 36R are sufficiently elongated since cylindrical third members 38L and 38R can rotate within their receiving apertures and rods 63L and 63R can also be rotated. Collars 38C fitting tightly over 38L and 38R are an appropriate means of securing the rod to the brackets when their third members are substantially horizontal as in FIG. 5.

All of the above have circular apertures that cooperate with the cylindrical third members of the preferred bracket of FIGS. 1A and 1B. However, third members and corresponding apertures of different cooperating shapes are also possible, and may be preferred when apertures are formed with non-slip brackets rather than within the drapery rod itself as shown below.

Figure 6:
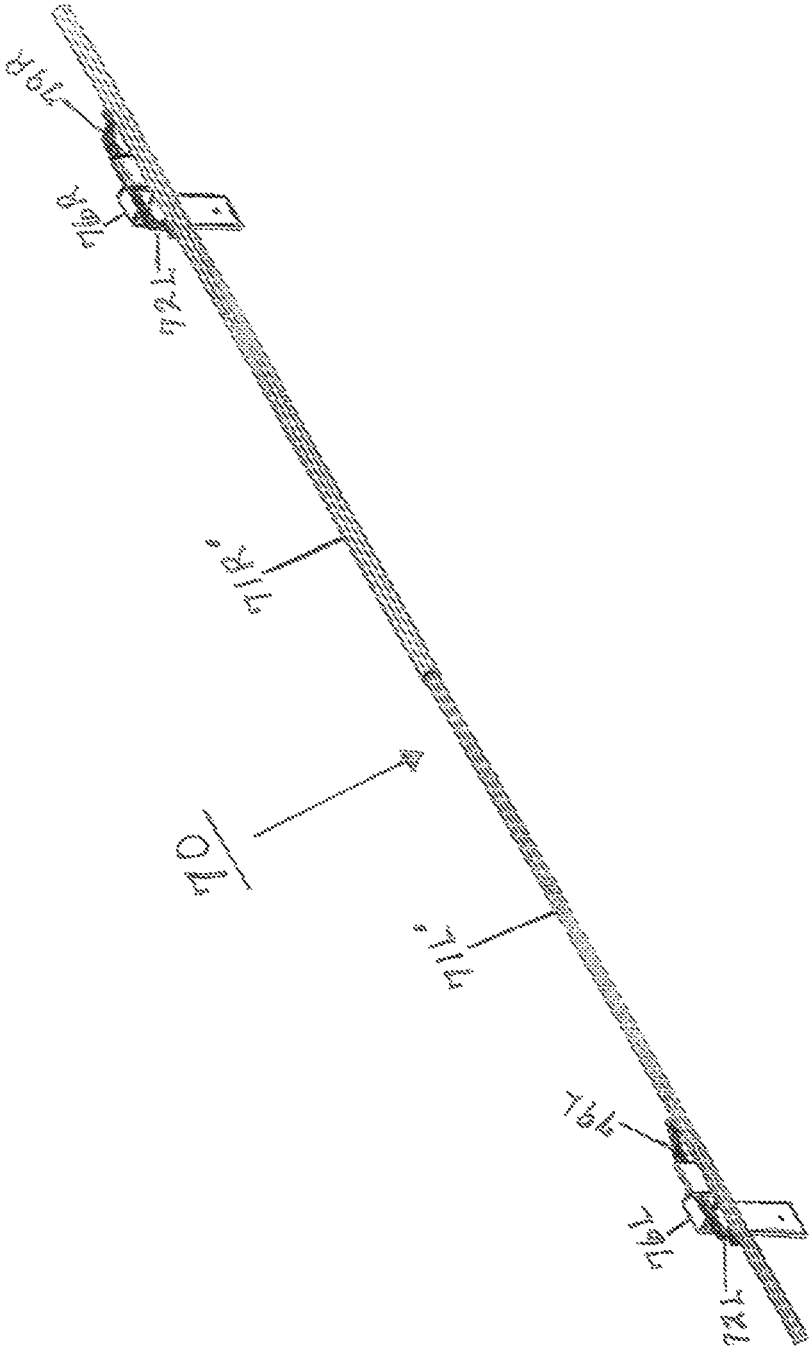
FIG. 6 shows the preferred embodiment of the non-motorized single-drapery rod with non-slip brackets.

FIG. 6 shows an embodiment of the non-motorized single-drapery rod with non-slip brackets and comprised of telescoping substantially straight rods 71L' and 71R' together. Non-slip brackets attach to 70 at points substantially adjacent to the single-drapery rod's ends. Non-slip brackets 72L and 72R arch away from and back into the rods to form substantially perpendicularly disposed apertures 79L and 79R. Wall mounting brackets 76L and 76R attach to a wall or other substantially vertical support surface and cooperate with the surrounding surfaces of apertures between non-slip brackets 72L and 72R and rods 71L' and 71R' to secure the single-drapery rod.

Figure 7A:
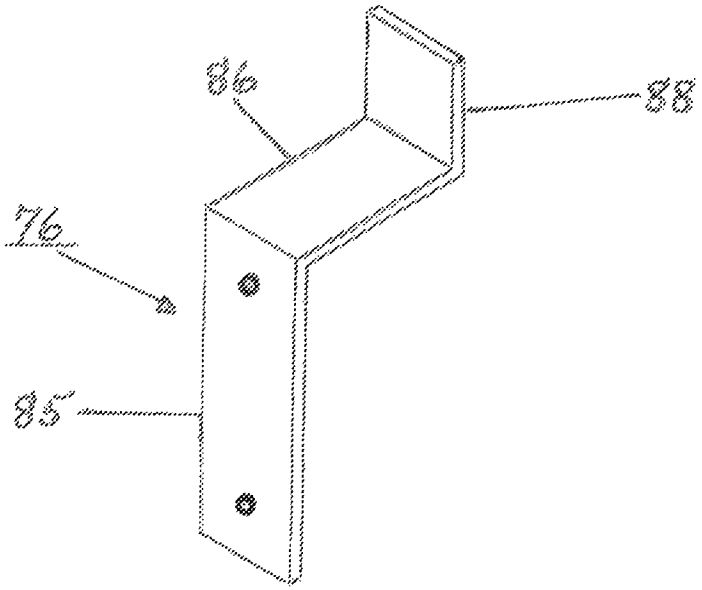
FIG. 7A is a perspective view of the non-adjustable wall mounting bracket that cooperates with those non-slip brackets.

FIG. 7A is a perspective view of the non-adjustable version of the wall mounting bracket that cooperates with non-slip brackets. Wall mounting bracket 76 includes a first member comprised of a base plate 85 with a vertically elongated body, a second member 86 having a horizontally elongated body extending substantially perpendicularly from base plate 85, and a third member 88 having a vertically elongated body extending upwardly and substantially perpendicularly from second member 86. The three members may be formed from a single elongated plate or made from two or more plates attached together using some method such as welding, brazing, or fusion. First member 85 is adapted to attach to a wall or other vertical support surface using screws, wall anchors, or other attachment means (not shown) while second member 86 engages the bottom surface of the non-slip brackets and third member 38 engages the surrounding surfaces of the apertures created by the opposing surfaces of the non-slip bracket and drapery rod.

Figure 7B:
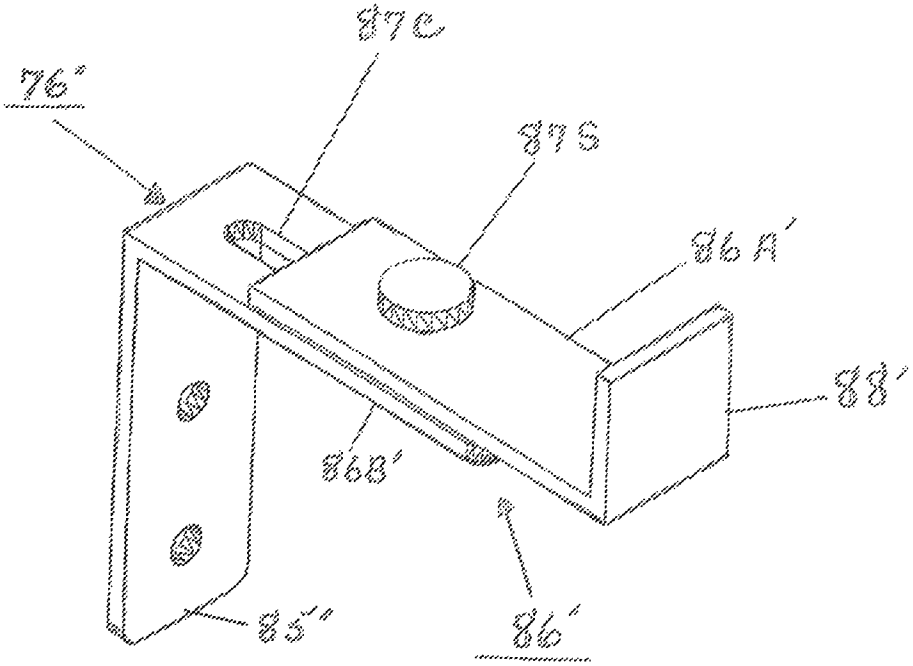
FIG. 7B is a perspective view of the adjustable bracket.

FIG. 7B is a perspective view of the adjustable version. Second member 86' of adjustable wall mounting bracket 76' is comprised of upper and lower second members 86A' and 86B'. Longitudinally disposed channel 87C in 86B' cooperates with an adjustment screw (not shown) operated with an attached head 87S to adjust 86' for desired clearance from the support surface without the need for tools. 87S is turned to loosen the screw and allow 86A' to be extended or refracted along 87C, with the range of motion being determined by the length of 87C. 87S is turned to tighten the screw at the appropriate point for desired clearance from the support structure.

Although many drapery rod embodiments have been shown and described, additional ones are possible. However, the embodiments described here should be sufficient to illustrate the principles and implementations of the non-motorized single drapery rod assembly and make its nature, objects, and advantages apparent to those skilled in the art. The embodiments displayed and described below illustrate the motorization of this assembly.

FIGS. 8-11 show embodiments of the multi-purpose drapery rod assembly that motorize and mount a traverse rod on the preferred wall mounting bracket. The structure and operation of the traverse rod are described only to the extent necessary for context. Detailed descriptions of the traverse rod and its operation are available not only from early patents but also from a variety of readily available sources such as instructions that typically come with the rod and are available on how-to internet sites.

Figure 8:
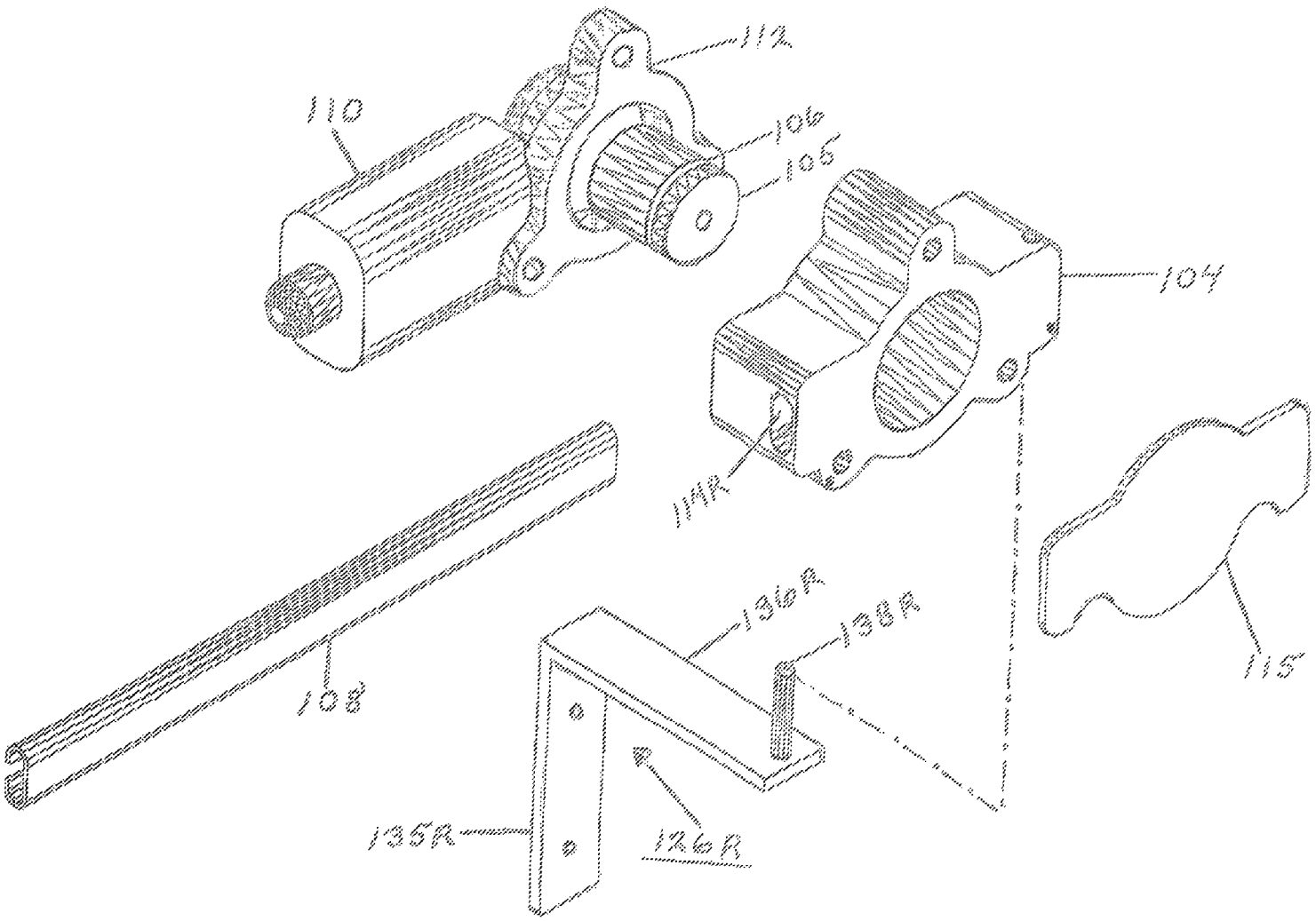
FIG. 8 is a perspective front view of the components of a right-engaging motorized drapery rod assembly with a partial view of a cooperating traverse rod.

FIG. 8 is a perspective front view of the components of a right-engaging motorized drapery rod assembly with a partial view of a cooperating traverse rod. (The placement of the assembly on the right side is arbitrary. A left-engaging assembly using the same components rearranged is also possible.) The assembly is less complex structurally than prior art and does not require the transmission cord to be redirected before it is wound around the motor's wheel or drive pulley. Prior art employs multiple wheels and/or clips with channels to redirect the cord vertically before engaging a pulley wheel, then redirects it back horizontally before the cord re-enters the traverse rod (e.g., see US 2006/0162877 A1 and 7360576 B2). This increases the complexity of the assembly and may decrease efficiency and contribute to slippage. U.S. Pat. No. 7,360,576 B2 purports to combat the slippage problem, but still requires redirection of the transmission cord and appears to increase rather than decrease structural complexity.

Referring to FIG. 8, a traverse rod aperture 114R penetrates the front surface of drive pulley housing 104 which contains a drive pulley 105 with a drive pulley groove 106 to receive a transmission cord (shown in FIG. 10) from traverse rod 108. Reverse electric motor 110 is positioned in front of and coupled with right-angled drive 112 to rotate 105. Rubber (not shown) coats 106 to increase traction of the transmission cord. Traverse rod aperture 114R is sized to receive the right end of horizontally disposed traverse rod 108 while said traverse rod's transmission cord is wound around 106 of drive pulley 105 (which replaces the traverse rod's right pulley and cord tension pulley). Since 105 is directly across from the open end of traverse rod 108 when the rod is inserted horizontally into aperture 114R, the traverse rod's transmission cord does not have to be redirected before winding around 106. A set screw (not shown) tightens to hold the traverse rod in place.

Figure 9:
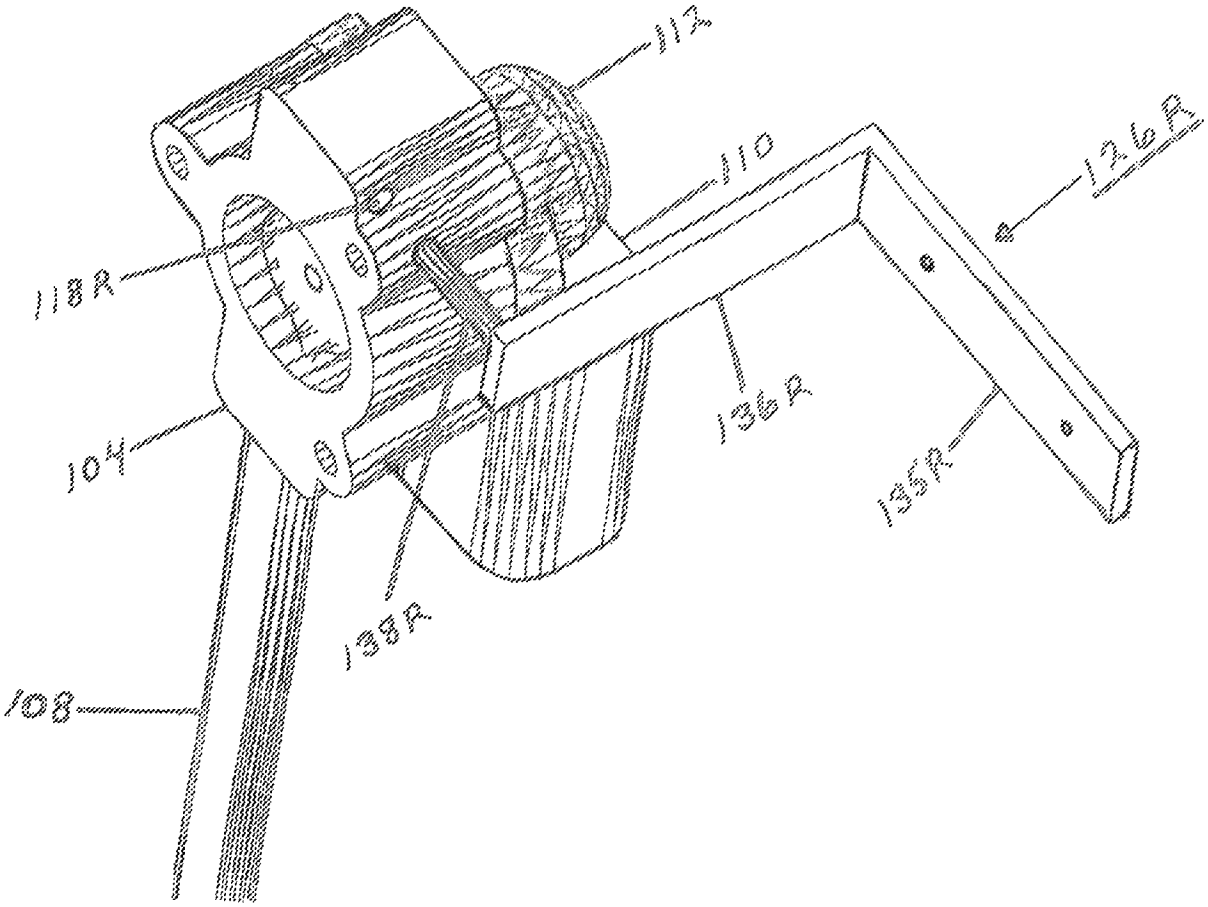
FIG. 9 is a perspective view from below and behind the drive pulley housing of FIG. 8.

Wall mounting bracket 126R cooperates with a aperture 118R shown in FIG. 9 penetrating the bottom surface of 104 to support the assembly. 126R is structurally identical to the preferred wall mounting bracket shown in FIG. 1A, with a first member comprised of a base plate 135R having a vertically elongated body, a second member 136R having a horizontally elongated body extending substantially perpendicularly from 135R, and a third member 138R having a vertically elongated cylindrical body extending upwardly and substantially perpendicularly from 136R. Base plate 135R is adapted to attach to a wall or other vertical support surface while 136R engages the bottom surface of 104 and third member 138 engages the surrounding surfaces of aperture 118R (see FIG. 9), thereby mounting the assembly and the right end of the traverse rod to a support surface. (The left end of the traverse rod is supported with a traditional traverse rod support bracket not shown). Face plate 115 attaches to the face of 104. Small apertures penetrate the face and end of 104 and intersect with like apertures penetrating its bottom surface to receive drapery hooks that are used with traverse rods (not shown). This allows drapery that is hung from the traverse rod to also be hung across the face and around the back end of housing 104.

FIG. 9 is a perspective view from below and behind drive pulley housing 104. Aperture 118R penetrates the bottom surface of 104 at an angle substantially perpendicular to traverse rod 108. 118R is sized to receive third member 138R of 126R while second member 136R engages the bottom surface of 104 and 135R engages a wall.

FIG. 10 provides a front view of take-up pulley housing 129 and drive pulley housing 104 with traverse rod 108 in between. Traverse rod 108 is separated in the middle to better show transmission cord 132, which wraps around take-up pulley 130 and drive pulley 105. Mounting brackets 126L and 126R are also separated from the housings, as are face plates 115 and 116 and cord guard 128 for take-up pulley 130. Cord guard 128 keeps transmission cord 132 from slipping off pulley 130. The ends of cord 132 are not shown, but are drawn tight and tied off at the traverse rod carriers as described in standard instructions accompanying the rods. A tension spring (not shown) is used at one end to maintain tension on the cord.

FIG. 11 is a perspective front exploded view of a second embodiment of the drive pulley apparatus with other key components and a partial view of the cooperating traverse rod. The second embodiment is more complex than the first, incorporating additional parts designed to deal with the cord slippage problem common with motorized drapery rod assemblies. Traverse rod aperture 114R penetrates the front surface of drive pulley housing 107 containing a drive pulley with a large-diameter portion 109 and a smaller-diameter groove portion 111. 111 receives transmission cord 132 from traverse rod 108. Reverse electric motor 110 is again positioned in front of and coupled with right-angled drive 112. Traverse rod aperture 114R (not shown) is sized to receive the left end of 108 while transmission cord 132 is wound around 111. Friction wheel 140 and tension bushing 142 have holes in their centers which allow 140 and 142 to fit tightly around 111. 111 is threaded at its end to receive tension nut 146. 140 is first fitted over 111 and up against 132, then 142 is fitted over 111 and up against 140. A tension spring 144 is then slipped over 111 and held in place by 146, which is tightened to create desired tension to prevent slippage of 132. Tension cap 148 attaches to 107 with screws and includes a tension cap crown 149 which provides clearance for 111. Wall mounting bracket 126R supports the assembly, third member 138R engaging the surrounding surfaces of aperture 118R shown in FIG. 9 while second member 136R engages the bottom surface of 107 (not shown) and 135R engages a wall.

The invention claimed is:

1. A drapery rod assembly comprising:

a. a drapery rod made of a rigid material with top and bottom surfaces and comprised of a drive pulley housing with a face and front and back ends;

b. a first drapery rod aperture extending into said drive pulley housing substantially adjacent to said back end at a pre-determined angle;

c. a first traverse rod aperture penetrating said front end of said drive pulley housing;

d. a mounting bracket comprised of a first member base plate, a second member extending away from said base plate, and a third member comprised of an element having a base and a distal end extending away from said second member;

i. said base plate being adapted to engage a support surface and including connecting means to attach said base plate to said support surface;

ii. and said third member being sized and shaped to engage inside surfaces surrounding said first drapery rod aperture;

iii. said third member being disposed at said pre-determined angle when said base plate is attached to said support surface;

e. a motorized assembly comprised of a reverse electric motor and a right-angled drive connected to a drive pulley housed in said drive pulley housing;

f. said drive pulley has a drive pulley groove sized and adapted to receive a transmission cord from a traverse rod and hold said transmission cord within said groove, thereby allowing said motor to release and drawback said cord; and g. said traverse rod aperture is sized and shaped to receive and engage one end of said traverse rod when said traverse rod is disposed in a substantially horizontal direction and said drapery rod is mounted on said mounting bracket.

2. The drapery rod assembly of claim 1 wherein a. said drapery rod includes a take-up pulley housing with front and back ends;

b. a second drapery rod aperture extends into said take-up pulley housing substantially adjacent to said back end and at said pre-determined angle;

c. said assembly includes a take-up pulley housed in said take-up pulley housing;

d. a second traverse rod aperture extends into said front end of said take-up pulley housing; and e. said traverse rod aperture on said take-up pulley housing receives and engages the other end of said traverse rod while said transmission cord is wound around said take-up pulley.

3. The drapery rod assembly of claim 2 wherein a. said drive-pulley housing and said take-up pulley housing each include said non-slip bracket; and b. said drapery rod apertures are formed by said non-slip brackets arching away and back into said drive-pulley and take-up pulley housing in a plane substantially parallel it said traverse rod when said traverse rod is disposed in a substantially horizontal direction.

4. The drapery rod assembly of claim 2 wherein a. said second drapery rod aperture extends through said bottom surface of said take-up pulley housing at a substantially perpendicular angle to said traverse rod;

b. said second member of said mounting bracket extends away from said base plate at a substantially perpendicular angle, and said third member extends from said second member upwardly and at a substantially perpendicular angle from said second member; and c. said third member engages the surrounding surfaces of said drapery rod aperture while said second member engages said bottom surface of said take-up pulley housing, thereby securing said housing from movement when said base plate is attached to said support surface.

5. The drapery rod assembly of claim 4 wherein said third member of said mounting bracket is cylindrically shaped.

6. The drapery rod assembly of claim 1 wherein said drive pulley is a split-groove pulley with a friction wheel, tension bushing, tension spring, and a threaded end to receive a tension nut;

a. said pulley includes a large-diameter portion and a groove portion, said large-diameter portion having a larger diameter than said groove portion;

b. said large-diameter portion is located between said right angled drive and said groove portion;

c. said groove portion has a smaller diameter than said friction wheel and tension bushing;

d. center holes in said friction wheel and tension bushing permit said wheel and bushing to fit tightly over said groove portion, said friction wheel fitting over said groove portion and up against said transmission cord and said tension bushing fitting over said groove portion and up against said friction wheel;

e. said tension spring fits over said groove portion; and f. said tension nut is threaded onto the end of said groove portion and tightened, compressing said spring and increasing tension as necessary to prevent transmission cord slippage.

7. The drapery rod as assembly of claim 1 wherein a. said first drapery rod aperture extends through said bottom surface of said drive pulley housing at a substantially perpendicular angle to said traverse rod;

b. said second member of said mounting bracket extends away from said base plate at a substantially perpendicular angle, and said third member extends from said second member upwardly and at a substantially perpendicular angle from said second member; and c. said third member engages the surrounding surfaces of said drapery rod aperture while said second member engages said bottom surface of said housing, thereby securing said housing from movement when said base plate is attached to said support surface.

8. The drapery rod assembly of claim 7 wherein said third member of said mounting bracket is cylindrically shaped.

9. The drapery rod assembly of claim 1 also comprising face end, and bottom surface apertures;

a. said face and end apertures intersect with said bottom surface apertures; and b. said face end, and bottom surface aperture are sized to receive drapery hooks commonly used with traverse rods.

10. The drapery rod assembly of claim 1 wherein a. said drive-pulley housing includes said non-slip bracket; and b. said drapery rod aperture is formed by said non-slip bracket arching away and back into said drive-pulley housing in a plane substantially parallel to said traverse rod when said traverse rod is disposed in a substantially horizontal direction.

* * * * *